US006231322B1

(12) United States Patent
Adolfsson

(10) Patent No.: US 6,231,322 B1
(45) Date of Patent: May 15, 2001

(54) METHOD AND DEVICE FOR THE PRODUCTION OF BEVERAGES

(75) Inventor: Bengt Adolfsson, Stockholm (SE)

(73) Assignee: Post-Mix Equipment AB (SE)

( * ) Notice: Subject to any disclaimer, the term of this patent is extended or adjusted under 35 U.S.C. 154(b) by 0 days.

(21) Appl. No.: 09/242,940

(22) PCT Filed: Aug. 27, 1997

(86) PCT No.: PCT/SE97/01421

§ 371 Date: Mar. 16, 1999

§ 102(e) Date: Mar. 16, 1999

(87) PCT Pub. No.: WO98/08769

PCT Pub. Date: Mar. 5, 1998

(30) Foreign Application Priority Data

Aug. 30, 1996 (SE) ..... 9603170

(51) Int. Cl.[7] ..... F04B 39/10; F04B 53/10

(52) U.S. Cl. ..... 417/534; 261/35

(58) Field of Search ..... 62/238; 74/31; 137/99; 222/1; 261/35, 82; 417/404, 403, 393, 534

(56) References Cited

U.S. PATENT DOCUMENTS

| | | | | |
|---|---|---|---|---|
| 3,672,389 | * | 6/1972 | McConnell | 137/99 |
| 3,700,360 | * | 10/1972 | Shaddock | 417/404 |
| 3,756,576 | * | 9/1973 | Tremolada | 261/35 |
| 3,823,573 | * | 7/1974 | Cassady | 62/238 |
| 4,136,706 | * | 1/1979 | Cosentino | 137/99 |
| 4,354,806 | | 10/1982 | McMillin et al. . | |
| 4,637,783 | | 1/1987 | Andeen . | |
| 4,658,760 | | 4/1987 | Zebuhr . | |
| 4,708,827 | * | 11/1987 | McMillin | 261/35 |
| 4,779,761 | * | 10/1988 | Rudick et al. | 222/1 |
| 4,839,107 | * | 6/1989 | Rudick et al. | 261/82 |
| 4,859,376 | * | 8/1989 | Hancock et al. | 261/35 |
| 4,889,662 | * | 12/1989 | Smith | 261/35 |
| 4,927,567 | * | 5/1990 | Rudick | 261/35 |
| 5,234,322 | * | 8/1993 | Daniels et al. | 417/403 |
| 5,332,372 | * | 7/1994 | Reynolds | 417/393 |
| 5,406,859 | * | 4/1995 | Belford | 74/31 |
| 5,545,016 | * | 8/1996 | Wang | 417/393 |
| 5,573,385 | * | 11/1996 | Chevallier | 417/393 |
| 6,017,200 | * | 1/2000 | Childs et al. | 417/404 |

FOREIGN PATENT DOCUMENTS

| | | |
|---|---|---|
| 2 732 727 | 10/1996 | (FR) . |
| 1 323 492 | 7/1973 | (GB) . |
| WO 88/09906 | 12/1988 | (WO) . |

* cited by examiner

*Primary Examiner*—Teresa Walberg
*Assistant Examiner*—Leonid Fastovsky
(74) *Attorney, Agent, or Firm*—Akerman Senterfitt

(57) ABSTRACT

The invention concerns a method and a device producing beverages in a beverage making machine, wherein inside a pressure vessel (2) water is stored, carbonated and possibly chilled under pressure and wherein water intended to be fed into the pressure vessel is subjected to an increase of pressure in a water inlet circuit between a feed water intake (11, 12) and the pressure vessel (2). The invention is distinguished in that carbonated water which is discharged from the pressure vessel (2) in a water outlet circuit (10, 11, 12) is subjected to a controlled pressure reduction or decompression in order to counteract excessive loss of carbon dioxide which is dissolved in the water by supplying it to a pressure transfer device so that the pressure of this water together with the pressure in incoming (11, 12) feed water is used to obtain said increased pressure. The invention prevents excessive loss of carbon dioxide which is dissolved in the water.

12 Claims, 1 Drawing Sheet

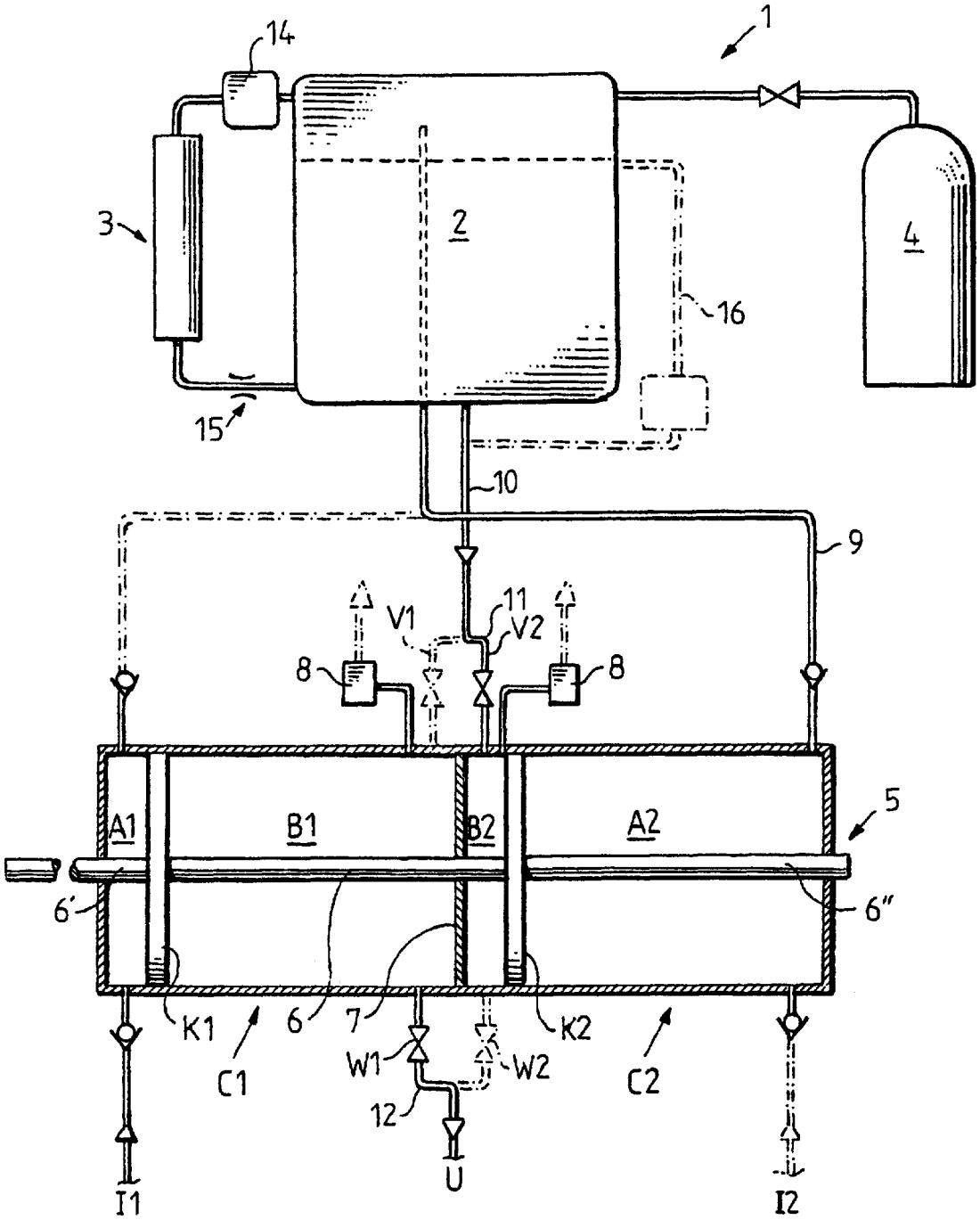
1
14
2
3
4
16
15
10
9
V1
11
V2
8
8
5
A1
B1
B2
A2
6'
6"
K1
6
7
K2
C1
W1
W2
C2
12
U
I1
I2

METHOD AND DEVICE FOR THE PRODUCTION OF BEVERAGES

This invention concerns a method and device according to the preamble of claim 1 and the preamble of claim 2 respectively.

Automatic beverage making machines for post-mixing or subsequent mixing carbonated and chilled water with a taste-giving concentrate into a certain quantity of a soft drink are previously known. In such devices the incoming fresh-water is fed over a pump to a pressure vessel where carbonating and possibly chilling may be provided under a relatively high pressure, typically amounting to 10 bar.

An essential problem with previously known post-mix devices is that excessive loss of carbon dioxide from the carbonated and chilled water is likely to appear at the discharge of the water when it is subjected to a sudden pressure reduction. The result of this is that there is a risk of providing a beverage having too low carbon acid contents which does not meet the specified demands and which is not accepted by the customer.

It is an aim of this invention to provide a method and a device in beverage making machines wherein the above problems are avoided or at least reduced.

This aim is obtained in a method and a device according to the above by the features of the characterising portions of claim 1 and 2 respectively.

By thus the carbonated and possibly chilled water which is discharged from the pressure vessel being subjected to a controlled pressure reduction by supplying it to a pressure transfer device, so that it is used together with the incoming fresh water in order to obtain a pressure increase of the water which is intended to be fed into the pressure vessel, it is achieved a controlled, non momentary pressure reduction or decompression in the discharged water which results in a greater portion of the carbon dioxide which is dissolved in the water remaining in the solution, instead of, as otherwise, risking to be uncontrolled lost to the atmosphere.

By the invention the said problem in conventional post-mix devices is thus solved, namely that discharge of carbonated water result in sudden decompression, resulting in excessive loss of carbon dioxide which is solved in the water. This problem is strongly accentuated in the prior art when using greater vessel pressures in the range of 25 bar, wherefore the control of the carbon acid contents is of the greatest importance in such applications. The invention solves the problems with excessive carbon dioxide loss at the same time as it provides a possibility to practically use relatively high pressure inside the pressure vessel which is desirable for the following reason.

An important aspect in post-mix machines namely concerns condensation of gaseous carbon dioxide which is present in the pressure vessel. In order to achieve this condensation the gas is fed over a compressor to the condenser whereas the prevailing pressure in condenser should be in the range of 65 bar in order to obtain effective condensation. When using a vessel pressure in the order of 10 bar it is thus necessary for this compressor to effect a increase of pressure of 55 bar which generally result in a need of a complicated multi-step compressor. A great increase of pressure further results in an undesired great heat release, possibly including intermediate cooling, and energy consumption. The invention makes it possible to use a higher pressure in the pressure vessel, typically for example 25 bar, without any need for a powerful, energy consuming feed pump, whereby the compressor feeding the condenser thus only has to provide an essentially lower increase of pressure than otherwise would be needed.

By the invention it is further achieved that no or at least little energy has to be supplied in order to increase the pressure in the feed water in order to the reach the pressure level inside the pressure vessel. The energy transfer means that in the case where the feed water has sufficient energy when it is discharged from a feed water supply, this energy together with the energy of the water in the water discharge circuit is sufficient to replace carbonated water discharged from the pressure vessel with new water having sufficient pressure in order to allow it to be fed into the pressure vessel. In the case where the feed water pressure is insufficient it may be necessary to provide a beverage making machine according to the invention with a simple pump having the ability of increasing the water pressure with for example 2 to 4 bar. Also in this case a significant advantage is achieved in comparison with prior art machines where the water pump must increase the pressure in the incoming water with as an example up to 10 bar.

Finally, the invention result in considerable saving of energy since all or at least essential parts of the energy which is required to pump new water into the pressure vessel is energy which is recovered from water being discharged from the pressure vessel and feed water. Machines applying the invention may also be produced with essentially reduced dimensions.

The feature in claim 3 and in particular in claim 4 provide a mechanically simple and reliable pressure transfer device.

Further features and advantages are achieved according to the other claims and are apparent by the following description of an embodiment which is described with reference to the drawing wherein the only FIGURE concerns a device according to the invention in an elementary diagram.

In the FIGURE numeral 1 diagramatically concerns parts of a beverage making machine of the post-mix type which parts are included in a device for cooling and carbonating water which is intended to be the main ingredient of a quantity of the post-mix beverage. 2 indicates a pressure vessel containing equipment for cooling and carbonating under pressure. A compressor 14 is connected to the pressure vessel as is a condenser 3 over a throttle 15 and a carbon dioxide source 4. These parts are of a per see previously known type and are not described in more detail in this application.

A water inlet circuit I1, I2, 9 and a water outlet circuit 10, 11, 12 are connected to the pressure vessel 2, whereby feed water from for example a municipal distribution circuit is coming in at I1 and I2 respectively. Incoming water is supplied to a pressure transfer device 5 which in this embodiment is a double piston cylinder device. The device 5 comprises two series-connected cylinders C1 and C2 wherein two pistons K1 and K2 respectively are sealingly axially displaceably moveable. The pistons are firmly connected to each other over a piston rod 6. The piston rod 6 is sealingly drawn through a wall 7 separating the cylinders C1 and C2. In order to obtain equal piston areas and thus similar feed quantities into and out from the pressure vessel, through piston rods 6' and 6" are arranged in the volumes A1 and A2 respectively. The pistons divide the respective cylinder into two volumes A1, B1 and A2, A2 respectively, whereby the water inlet pipes I1 and I2 are connected to the volumes A1 and A2 respectively, each over a one way valve. The outlet pipe 10, 11 is connected to the B-volumes over valves V1 and V2 respectively. At the outlet side of the B-volumes there is further connected a water outlet pipe 12, U over valves W1 and W2, for the supply of carbonated water to a beverage mixing station (not shown). Further, in order to regulate the excess contents of gas in the volumes B1, B2, a gas-liquid filter 8 is preferably connected to each B-side, which filter has the capacity to allow passage of gas but prevent passage of a liquid such as water. This filter may have a carbon dioxide feed back (not shown) to the pressure vessel or the carbon dioxide circuit. As an alternative, the water outlet from the B-volumes can be arranged at the top in order to assure safe discharge of excess gas.

The pressure transfer device 5 works according to the following:

In the shown phase the pistons K1 and K2 are in their left end positions, whereby the volume A2 in the cylinder C2 is filled with water to be supplied under pressure to the pressure vessel 2. The volume B2 of the cylinder C1 is filled with carbonated and possibly chilled water emanating from the pressure vessel 2 to subsequently be fed to a mixing station. The pressure transfer device 5 is now controlled with the valves V1, V2 and W1, W2. In the phase shown in the FIGURE the outlet pipe 10 of the pressure vessel 2 is connected to the B2 volume of the cylinder C2 by the V1 valve being closed while the V2 valve is open. Thereby and by also the W2 valve being closed in this phase it is achieved that the volume B2 inside cylinder C2 is connected to the pressure vessel 2 in such a way that the pressure of the pressure vessel will essentially also be prevailing in the volume B2. Because a previously determined pressure (as an example 3–5 bar) is prevailing in the volume A1 because of the connection of this volume to the feed water pipe, the added forces on the double piston K1, K2 will strive to press it to the right as seen in the FIGURE. The pressures in the volume B1 and A2 are of course acting in the opposite direction. Now when valve W1 is opened in order to discharge chilled and carbonated water inside the volume B1 to the mixing station, the pressure on this side will be reduced whereby the forces acting to the right in the FIGURE are capable of increasing the pressure in the volume on the A2 side so that water inside this volume will be pressed into the pressure vessel 2.

When this phase is terminated so that the double piston K1, K2 will be in the right extreme position (not shown), the valves V1, V2 and W1, W2 are shifted so that the procedure is repeated in a similar manner but having the double piston K1, K2 acting in the direction to the left in the FIGURE. A quantity of water which in use is fed into the pressure vessel corresponds to the quantity which occasionally is collectively discharged from the volume B1, B2, for example for one or more glasses of soft drink.

The invention is not limited to the construction shown in the FIGURE but also other pressure transfer devices may come into question which function as energy recoverers, for example such having rotational pistons or working according to the gear type pump principle. In such cases a gear type pump may be connected in parallel on a common shaft with two "gear type motors" wherein the gear type pump is arranged for the pumping of new water into the pressure vessel 2 while the first motor is driven by water being discharged from the pressure vessel 2 and the second motor by incoming feed water.

Instead of through piston rods 6' and 6" in order to obtain a balanced, compensated feed, the mouths of the conduits 9 in the cylinder C1, C2 may be arranged displaced somewhat to the middle of the device 5 so that they together with the respective piston will form a "valve" when an adequate water quantity has been fed into the pressure vessel. The remaining water quantity can be pressed back to the feed conduit over some (not shown) valve arrangement.

In case there is insufficient pressure in the municipal circuit feed water, or where no such circuit is provided what so ever, a simple pump may be arranged before the water inlet to the pressure transfer device. As has been indicated above this pump does not have to provide a greater pressure increase than in the order of 2–4 bar.

In case of a possibly undesired inflow of air together with or instead of feed water, which sometimes may occur, the excess quantity of gas, by the way also excess quantity of carbon dioxide, inside the pressure vessel 2 can be let out (through the pump in order to achieve the necessary balance between what is fed in and what is fed out) as a response to an indication from a water level detector, through a separate valve controlled pipe 16, leading to the conduit 10. In order to avoid gas to blow out at the preparation of beverages and disturbing the mixing proportions, a sensor may be arranged which in the event of excess gas automatically lets the gas out through an extra stroke of the pressure transfer device. Possibly the mouth of the conduit 10 inside the pressure vessel is arranged just below the desired water level whereby possible excess gas may be discharged directly through this conduit.

In order to assure that there is no overfill of water into the pressure vessel, the rod 6 may be made somewhat thinner than the rods 6' and 6". This way it is avoided that a greater quantity of water is fed into the pressure vessel than is fed out.

Finally, it is made possible by the invention to easily control the amount of discharged water by observing the pressure transfer device with respect to carried out transfer cycles, which allows simple control of the mixing proportion water—concentrate, a proportion which is to be set at the factory and for example only is allowed to be adjusted by certified personnel. In practice, concentrate may be dosed as a response to a measured quantity of discharged water.

What is claimed is:

1. A method for producing beverages in a beverage making machine, wherein inside a pressure vessel, water is stored, carbonated and possibly chilled under pressure, said method comprising the steps of:

subjecting water to be fed into the pressure vessel to an increase of pressure in a pressure transfer device in a water inlet circuit between a feed water intake and the pressure vessel, subjecting outgoing carbonated water which is discharged from the pressure vessel in a water outlet circuit to a controlled pressure reduction or decompression in the pressure transfer device, in order to counteract excessive loss of carbon dioxide which is dissolved in the water by supplying it to a pressure transfer device; and feeding the pressure of the outgoing carbonated water together with the pressure in incoming feed water into the pressure transfer device, in order to obtain said increased pressure.

2. A device in a beverage making machine which comprises a pressure vessel for storing under pressure, carbonating and possibly chilling water, a water inlet circuit which is connected to the pressure vessel and which includes a pressure increasing device between a feed water inlet and the pressure vessel, and a water outlet circuit which is connected to the pressure vessel, wherein said pressure increasing device is a pressure transfer device, which is arranged to be supplied with outgoing carbonated water in order to subject it to a controlled pressure reduction or decompression in order to counteract excessive loss of carbon dioxide which is dissolved in the water, and wherein the outgoing carbonated water in the water outlet circuit is arranged to be fed to the pressure transfer device such that the pressure thereof together with the pressure in the incoming feed water increases the pressure of the water to be fed into the pressure vessel.

3. The device according to claim 2, wherein the pressure transfer device is comprised of a linearly operating piston pump/piston motor.

4. The device according to claim 3, wherein the pressure transfer device is comprised of a double piston aggregate, wherein in the water outlet circuit, outgoing water together with incoming feed water effects a double piston in a direction of movement for feeding water into the pressure vessel.

5. The device according to claim 2, further comprising means for sensing excessive gas inside the pressure vessel and to automatically lets the gas out through the pressure transfer device.

6. The device according to claim 2, further comprising means to control the mixing proportion between the water and concentrate based on the quantity of outgoing water through the pressure transfer device.

7. The device according to claim 2, further comprising means for sensing excessive gas inside the pressure vessel and to automatically let the gas out through the pressure transfer device.

8. The device according to claim 3, further comprising means for sensing excessive gas inside the pressure vessel and to automatically let the gas out through the pressure transfer device.

9. The device according to claim 4, further comprising means for sensing excessive gas inside the pressure vessel and to automatically let the gas out through the pressure transfer device.

10. The device according to claim 2, further comprising means to control the mixing proportion between the water and concentrate based on the quantity of outgoing water through the pressure transfer device.

11. The device according to claim 3, further comprising means to control the mixing proportion between the water and concentrate based on the quantity of outgoing water through the pressure transfer device.

12. The device according to claim 4, further comprising means to control the mixing proportion between the water and concentrate based on the quantity of outgoing water through the pressure transfer device.

* * * * *